US009683408B2

(12) United States Patent
Jackson

(10) Patent No.: US 9,683,408 B2
(45) Date of Patent: Jun. 20, 2017

(54) PIVOTING STAIRS

(71) Applicant: Randy Jackson, Manchester, MI (US)

(72) Inventor: Randy Jackson, Manchester, MI (US)

( * ) Notice: Subject to any disclaimer, the term of this patent is extended or adjusted under 35 U.S.C. 154(b) by 0 days.

(21) Appl. No.: 14/740,840

(22) Filed: Jun. 16, 2015

(65) Prior Publication Data

US 2015/0361720 A1 Dec. 17, 2015

Related U.S. Application Data

(60) Provisional application No. 62/012,567, filed on Jun. 16, 2014.

(51) Int. Cl.

| | |
|---|---|
| ***E04F 11/02*** | (2006.01) |
| ***E06C 1/16*** | (2006.01) |
| ***E06C 1/34*** | (2006.01) |
| ***E06C 9/08*** | (2006.01) |
| *E04F 11/04* | (2006.01) |

(52) U.S. Cl.

CPC ..... *E06C 1/16* (2013.01); *E06C 1/34* (2013.01); *E06C 9/08* (2013.01); *E04F 11/04* (2013.01); *E04F 2011/0203* (2013.01)

(58) Field of Classification Search

CPC ..... E04F 2011/0203; E04F 11/04; E06C 1/16; E06C 1/34; E06C 9/08

USPC ..... 52/182, 183, 184, 187, 191; 182/115

See application file for complete search history.

(56) References Cited

U.S. PATENT DOCUMENTS

| | | | | | |
|---|---|---|---|---|---|
| 737,197 | A | * | 8/1903 | Benney | E04F 11/0255 182/94 |
| 1,149,786 | A | * | 8/1915 | Rowley | E06C 7/14 182/115 |
| 1,176,652 | A | | 3/1916 | Clark | |
| 3,232,376 | A | * | 2/1966 | Lucas | A01D 41/1261 182/113 |
| 3,392,990 | A | * | 7/1968 | Wolf | B60R 3/02 280/163 |
| 4,378,862 | A | * | 4/1983 | Carmel | E06C 1/383 182/106 |
| 4,434,884 | A | * | 3/1984 | Kettle | B65G 21/18 198/328 |
| 4,509,617 | A | * | 4/1985 | Lapeyre | E06C 1/38 182/106 |
| 4,946,004 | A | | 8/1990 | Henson | |
| 4,971,168 | A | * | 11/1990 | Stanescu | E06C 9/08 182/1 |

(Continued)

FOREIGN PATENT DOCUMENTS

| | | | |
|---|---|---|---|
| JP | 62059189 | A * | 3/1987 |
| JP | 07310414 | A * | 11/1995 |

*Primary Examiner* — Charles A Fox
*Assistant Examiner* — Charissa Ahmad
(74) *Attorney, Agent, or Firm* — John G. Posa; Belzer PC

(57) ABSTRACT

A swiveling staircase is provided for access to a device disposed above the ground at a distance that a person of an ordinary height is not able to reach. The staircase includes an immobile upright stanchion and a staircase assembly pivotally coupled to the stanchion. The staircase assembly includes a platform on the top of a plurality of stairs. The staircase assembly rotates between a first position where the staircase is docked out of way for storage and a second position where the staircase assembly is facing the front side of the device so that an operator standing on the platform may be able to reach the device.

6 Claims, 3 Drawing Sheets

(56) References Cited

U.S. PATENT DOCUMENTS

| | | | | | |
|---|---|---|---|---|---|
| 5,064,022 | A | | 11/1991 | Graham | |
| 5,158,167 | A | * | 10/1992 | Pahl | B66B 21/06 198/328 |
| 5,213,191 | A | * | 5/1993 | Tahara | B66B 21/06 198/328 |
| 5,460,240 | A | | 10/1995 | Jones | |
| 5,653,307 | A | | 8/1997 | Kerr | |
| 6,179,312 | B1 | * | 1/2001 | Paschke | B60R 3/02 105/444 |
| 6,230,841 | B1 | * | 5/2001 | Valore | E06C 1/39 182/15 |
| 6,264,222 | B1 | * | 7/2001 | Johnston | B60R 3/02 105/444 |
| 6,264,227 | B1 | * | 7/2001 | Johnson | B60R 3/02 180/9.1 |
| 6,817,433 | B1 | * | 11/2004 | Bergstrom | B62D 33/06 180/89.12 |
| 6,923,140 | B1 | * | 8/2005 | Cook | E01D 15/24 114/362 |
| 7,055,881 | B2 | * | 6/2006 | Kindred | A01B 51/026 180/89.12 |
| 7,237,636 | B2 | * | 7/2007 | Ruppert | B60R 3/00 180/210 |
| 7,354,050 | B2 | * | 4/2008 | Brockway | B60R 3/02 182/127 |
| 7,377,080 | B2 | * | 5/2008 | Mills | B64D 11/00 182/106 |
| 7,870,932 | B2 | * | 1/2011 | Lapke | B60R 3/02 182/127 |
| 2012/0080266 | A1 | * | 4/2012 | Brock | E04G 3/243 182/107 |

* cited by examiner

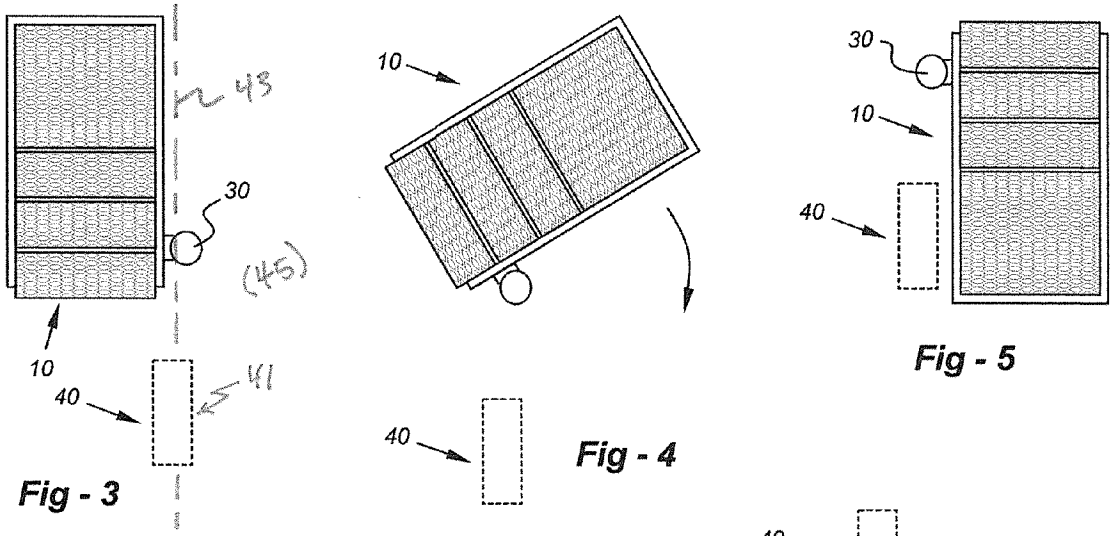
Fig - 5
Fig - 4
Fig - 3
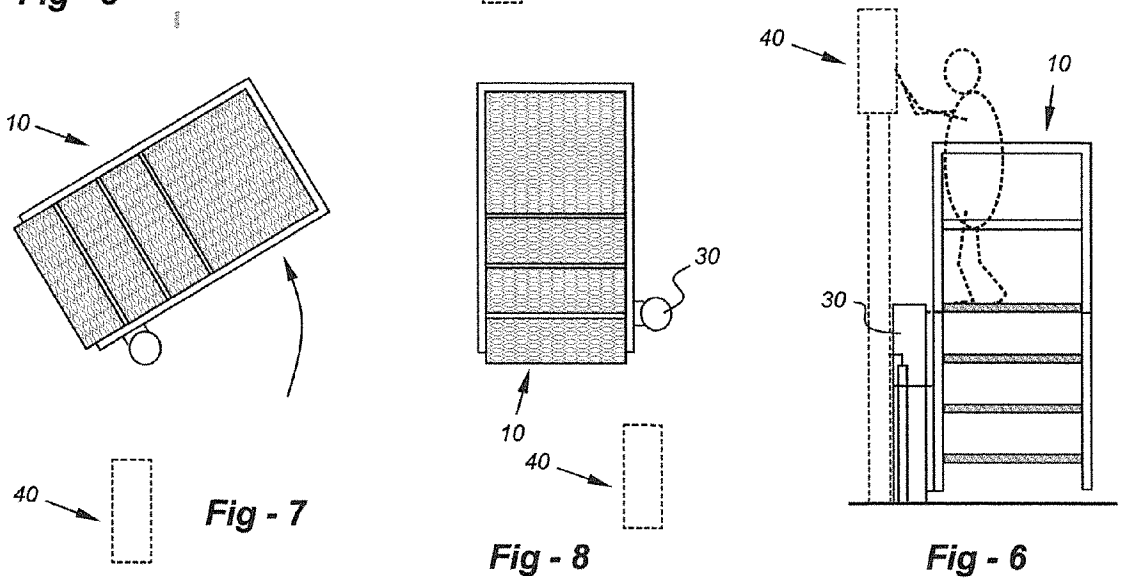
Fig - 6
Fig - 8
Fig - 7

PIVOTING STAIRS

REFERENCE TO RELATED APPLICATION

This application claims priority to U.S. Provisional Patent Application Ser. No. 61/012,567, filed Jun. 16, 2014, the entire content of which is incorporated herein by reference.

FIELD OF THE INVENTION

The present invention relates generally to a swiveling staircase that pivots about a pole. In particular, this invention relates to such staircase, which is intended to provide access to a high-off-the-ground device and may be rotated out of way when not in use.

BACKGROUND OF THE INVENTION

There are situations where drivers of large vehicles such as semi-trucks must interact with equipment as their vehicle passes through a check point such as a weight scale. Due to the height of the driver's cab, such equipment is high off the ground, requiring a staircase for installation or maintenance. These check points are often located relatively far from warehouses or storage spaces. Therefore, it is a hassle to transport a ladder or staircase to the equipment every time it needs to be accessed or serviced. However, if the staircase is permanently configured for easy access of such equipment, it may be in the way of vehicular traffic.

This invention solves the above problems with the provision of a staircase that pivots about a pole, thereby allowing the staircase to swivel into, and out of, position.

SUMMARY OF THE INVENTION

A swiveling staircase is provided for access to a device positioned above the ground at a distance that a person of an ordinary height is not able to reach. The device may be a device alongside of a roadway.

The swiveling staircase may include an upright stanchion which is fixed to the ground adjacent to the device.

The swiveling staircase may further include a staircase assembly pivotally coupled to the stanchion.

The swiveling staircase of this invention may be adapted to various types of staircases or ladders. Therefore, this invention is not limited to a specific type of staircase assembly.

The staircase assembly may further include a plurality of stairs supported by a supporting frame.

The staircase assembly may further include a platform at the top of the stairs on which an operator may stand in order to reach for the device.

The staircase assembly may further include hand rails on both sides of the stairs and additional railings around the platform to provide safety.

The staircase assembly may include a first position where the staircase sits alongside of the roadway next to the device.

The staircase assembly may include a second position where the staircase sits in the roadway facing the device. In this position, an operator may climb the stairs and stand on the platform in order to conveniently access the device. The staircase assembly in its second position may be in the way of vehicular traffic so it may need to be rotated out of traffic when the staircase assembly is not in use.

The staircase assembly may further include a vertical member for coupling to the stanchion and the bottom of the staircase assembly may be off-the-ground such that the staircase assembly is completely supported by the stanchion and freely rotatable about the stanchion.

The staircase assembly is rotatable about the stanchion for at least 180 degrees.

The staircase assembly may further include a locking mechanism for locking and unlocking the swiveling action.

The staircase assembly may be constructed from welded steel.

BRIEF DESCRIPTION OF THE DRAWINGS

FIG. 3 is a top-down view of showing that the staircase is parked out of roadway at its original docking position;

FIG. 4 is a top-down view of showing the staircase beginning to being swiveled about the pole clockwise towards the front side of the device;

FIG. 5 is a top-down view of the staircase in position facing the device;

FIG. 6 is a top-down view of showing an operator standing on the platform to access the device;

FIG. 7 is a top-down view of showing the staircase being swiveled about the pole counterclockwise back to its original docking position; and FIG. 8 is a top-down view of showing the staircase back to its original docking position.

DETAILED DESCRIPTION OF THE INVENTION

Figure 1:
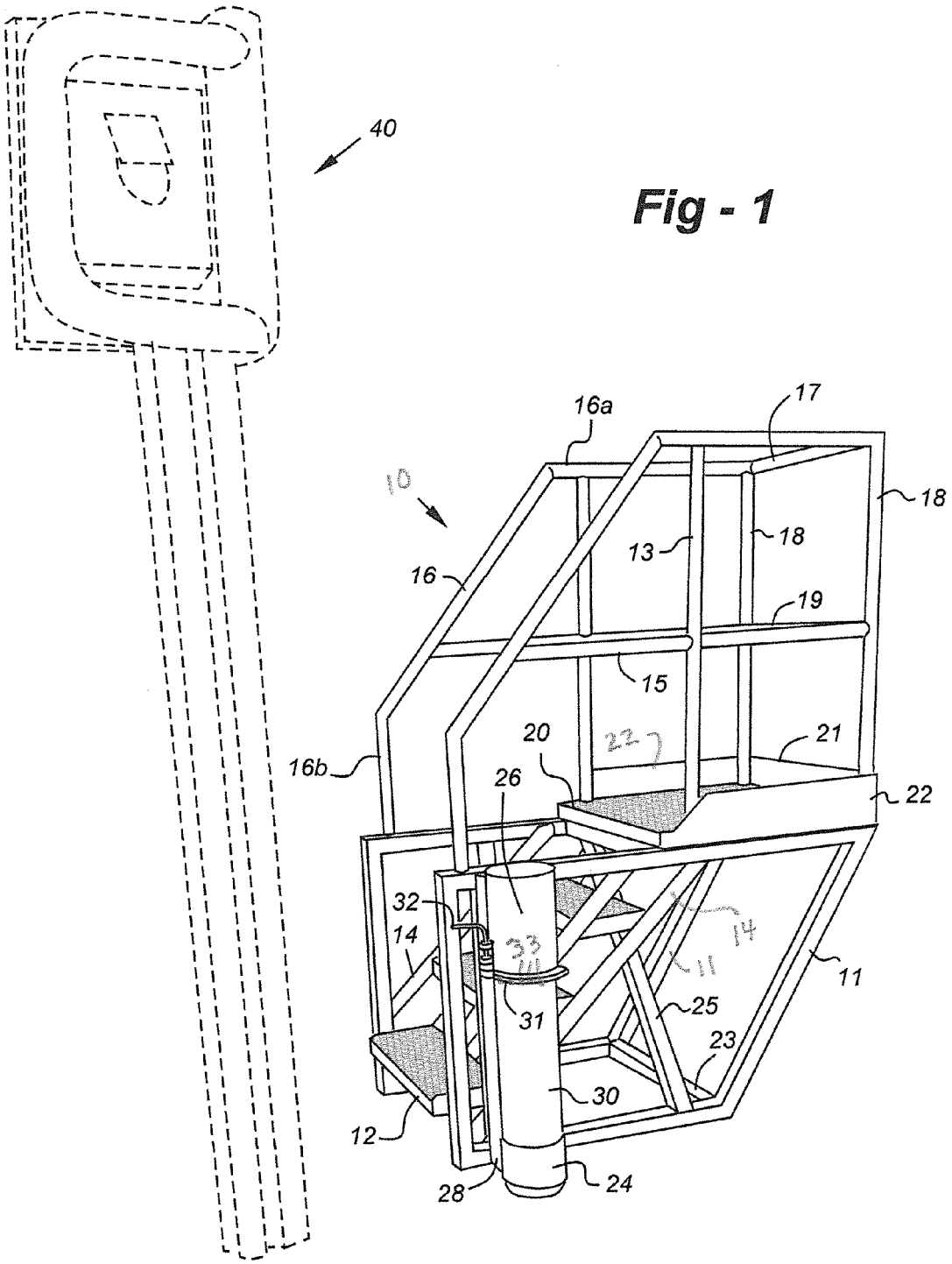
FIG. 1 is a perspective view of a staircase that swivels about an upright pole according to the invention.

As shown most clearly in FIG. 1, pivoting staircase 10 is a staircase assembly pivotally attached to a pole 30 on the ground. The staircase includes a lower part and an upper part.

The lower part of the staircase assembly incorporates a plurality of steps 12 and supported by a pair of side stringers 14, which are connected to a supporting frame. The supporting frame of the staircase assembly includes a pair of upside-down trapezoidal frames 11. The sides of the frames 11 which are adjacent to the lowest tread are vertical. The pair of upside-down trapezoidal frames are connected by a cross beam 23 such that the base of the supporting frame is rectangular or square in shape. An additional support member 25 may be provided for the stability of the supporting frame.

The upper part of the staircase assembly includes a platform 20, hand rails 16 and railings around the platform. The upper part of the staircase assembly sits on the top of the pair of the upside-down trapezoidal frames 11. The hand rails 16, including front vertical members **16*a* and top horizontal members 16*b*, are provided for use by a person climbing the stairs and are secured to vertical support beams 18 and top cross rail 17. Additional support members 13 and 15, which are a pair of bars perpendicular to each other, are provided for stability of the railings as well as for the extra safety enclosure. An additional cross beam 19 at the same height of the support members 15 is provided for extra enclosure as well. At the top of the platform 20 are a pair of parallel flanges 22 and a cross flange 21**, enclosing the three sides of the bottom portion of the upper part of the staircase assembly.

The upper part of the staircase assembly may be manufactured out of one-inch 16 gauge tubing which is standard in this industry. The bottom part of the staircase assembly may be manufactured out of welded steel. The design of the stair treads and various support beams are not critical to this invention, as it may be used with many different types of ladders.

Referring again to FIG. 1, the staircase assembly is attached to the pole 30 by a vertical member. The vertical member includes a top cap 26 and a bottom sleeve 24 connected by a vertical middle part 28. The pole 30 is cemented to the ground and not rotatable. The vertical member is attached to the pole 30 by the top cap 26 and the bottom sleeve 24. The bottom sleeve 24 and the bottom of the vertical middle part 28 are about 1-3 inches off the ground. The entire vertical member including the top cap 26, the vertical middle part 28 and the bottom sleeve 24 is freely rotatable about the pole 30. The staircase assembly is attached to the vertical middle part 28 and is completely supported by the pole 30 so that the staircase assembly is about 1-3 inches off the ground and freely rotatable about the pole 30 together with the vertical member.

A locking mechanism is provided to prevent the vertical member to rotate about the pole 30 when not intended. Referring back to FIG. 1, a circular metal plate 31 is provided in the middle of the upper half of the pole 30 and sits right below the bottom edge of the top cap 26. The circular metal plate 31 has a diameter larger than that of the pole 30 and includes a number of notches 33 circumferentially around its edge. A metal attachment with an aperture in the center of the metal attachment is attached to the side of the top cap 26 adjacent to the metal plate 31. When an L-shaped metal latch 32 is inserted through the aperture and into one of the notches of the metal plate 31, the vertical member is prevented from rotating about the pole 30, thus locking the staircase assembly in place As also shown in FIG. 1, adjacent to the staircase assembly is utilization device 40, not readily accessible to a person of an ordinary height, unless he stands on the top of the platform 20. In the disclosed example of a weight printer intended for access by a truck driver, the device 40 may be about 10 feet or more of the ground.

Figure 2:
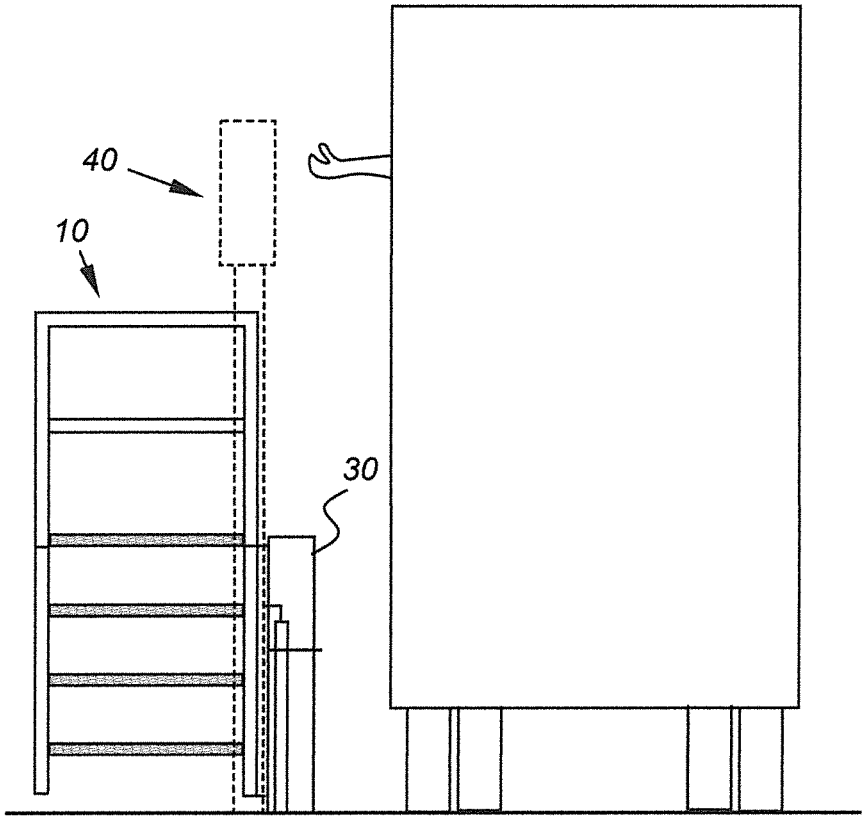
FIG. 2 is a rear view of a vehicle approaching a check point, in this case a semi-truck approaching an off-the-ground weight printer mechanism and driver taking a ticket.

FIG. 2 shows an example of the equipment 40 being a weight printer at a semi-truck weight station. The height of the equipment is at the same height as the driver's cab. FIG. 2 shows the driver of the semi-truck reaching for a ticket from the equipment from inside his cab. The staircase is docked out of the driveway of the semi-truck and securely parked along the sideline of the driveway.

In FIG. 3, the staircase is at its original position when it is out of the driveway. This figure also shows that the device 40 has a front side 41 and a sideline 43 of a path 45 used by truck traffic in this case.

When an operator pulls out the metal latch to unlock the staircase, the staircase is free to be rotated about the pole 30. FIG. 4 shows the staircase is in the process of being rotated clockwise about the pole 30 towards the front side of the equipment 40.

FIG. 5 shows that the staircase has been rotated 180 degree about the pole 30 and now faces the front of the equipment.

FIG. 6 shows a side view of the staircase facing the front of the equipment after being rotated for 180 degree so that an operator may now get up on the platform and conveniently access the equipment.

After the operator finishes servicing on the equipment, the staircase may be rotated out of the driveway and back to its original position so that the driveway is not blocked.

In FIG. 7, the staircase is being rotated counterclockwise away from the front of the equipment.

In FIG. 8, the staircase has been rotated for 180 degree counterclockwise and back to its original docking position out of driveway alongside the driveway.

The invention claimed is:

1. A swiveling staircase for providing user access to a stationary device positioned above a ground surface alongside a vehicle path, the device having a front side facing the vehicle path, the staircase comprising:

an immobile upright stanchion extending upwardly from a ground surface adjacent to the device, and wherein the immobile upright stanchion terminates in a top portion;

a staircase assembly pivotally coupled to the immobile upright stanchion through a rotatable cap configured to fit over the top portion of the stanchion;

wherein the staircase assembly includes an upper platform and a lower supporting frame with a plurality of stairs leading up to the platform;

wherein the staircase assembly is rotatable about the immobile upright stanchion through the rotatable cap between a first position and a second position;

wherein, in the first position, the staircase assembly is positioned outside of the path, enabling a vehicle to travel along the path without obstruction form the staircase assembly and, in the second position, the staircase assembly is rotated into the path such that the platform is adjacent to the device and immediately below the front side of the device, thereby enabling a user to climb the stairs and access the front side of the device while standing on the platform; and wherein the staircase assembly is supported by the rotatable cap on the stanchion so that the staircase assembly is off the ground surface as it is rotated back and forth between the first and second positions.

2. The swiveling staircase of claim 1, wherein the staircase assembly includes a vertical member coupled to the stanchion through the rotatable cap.

3. The swiveling staircase of claim 1, wherein the staircase assembly is rotatable through an angle of 180 degrees.

4. The swiveling staircase of claim 1, further including a mechanism for locking and unlocking the staircase assembly in the first and second positions.

5. The swiveling staircase of claim 1, wherein the staircase assembly includes handrails.

6. The swiveling staircase of claim 1, wherein the staircase is constructed from welded steel.

* * * * *